US006451460B1

(12) United States Patent
Sun et al.

(10) Patent No.: US 6,451,460 B1
(45) Date of Patent: Sep. 17, 2002

(54) THIN FILM ELECTROLUMINESCENT DEVICE

(75) Inventors: Sey-Shing Sun, Beaverton, OR (US); Michael S. Bowen, Beaverton, OR (US)

(73) Assignee: Planner Systems, Inc., Beaverton, OR (US)

( * ) Notice: Subject to any disclaimer, the term of this patent is extended or adjusted under 35 U.S.C. 154(b) by 20 days.

(21) Appl. No.: 09/658,820

(22) Filed: Sep. 8, 2000

(51) Int. Cl.[7] ..... H05B 33/00

(52) U.S. Cl. ..... 428/690; 428/917; 313/502; 313/503; 257/102; 252/301.4 R; 252/301.4 S

(58) Field of Search ..... 428/690, 917; 313/502, 503, 509, 506; 257/102; 252/301.4 R, 301.4 S

(56) References Cited

U.S. PATENT DOCUMENTS

| | | | | |
|---|---|---|---|---|
| 3,639,254 A | | 2/1972 | Peters | |
| 4,311,487 A | | 1/1982 | Luckey et al. | |
| 4,365,184 A | | 12/1982 | Higton et al. | |
| 4,719,385 A | | 1/1988 | Barrow et al. | |
| 4,751,427 A | | 6/1988 | Barrow et al. | |
| 4,897,319 A | | 1/1990 | Sun | |
| 4,983,469 A | | 1/1991 | Huzino et al. | |
| 5,059,861 A | | 10/1991 | Littman et al. | |
| 5,147,835 A | | 9/1992 | Franzak et al. | |
| 5,308,070 A | | 5/1994 | Wittaker | |
| 5,309,070 A | | 5/1994 | Sun et al. | |
| 5,346,776 A | | 9/1994 | Taniguchi et al. | |
| 5,505,986 A | | 4/1996 | Velthaus et al. | |
| 5,581,150 A | | 12/1996 | Rack et al. | |
| 5,598,059 A | | 1/1997 | Sun et al. | |
| 5,629,126 A | * | 5/1997 | Trutna, Jr. et al. | 430/139 |
| 5,693,254 A | | 12/1997 | Sieber et al. | |
| 5,742,322 A | | 4/1998 | Cranton et al. | |
| 5,939,825 A | | 8/1999 | Sun et al. | |
| 6,072,198 A | * | 6/2000 | Sun et al. | 257/103 |
| 6,074,575 A | * | 6/2000 | Sugioka et al. | 252/301.4 S |
| 6,169,359 B1 | | 1/2001 | Sun et al. | |
| 6,242,858 B1 | * | 6/2001 | Sun | 313/503 |

OTHER PUBLICATIONS

Tannas, Jr., Lawrence E., "*Electroluminescence Displays*," (At least one year prior to filing date) Van Nostrand Reinhold Company Inc.; 1985; pp. 237–288.

Baukol, B.A, et al., "*Electroluminescence Thermal Quenching in SrS: Cu Thin–Film Electroluminiscent Devices*," Center for Advanced Materials Research, Oregon State University, Corvallis, OR; Oct. 4, 1999; pp. 1–14.

(List continued on next page.)

*Primary Examiner*—Cynthia H. Kelly
*Assistant Examiner*—Dawn Garrett
(74) *Attorney, Agent, or Firm*—Chernoff, Vilhauer, McClung & Stenzel, LLP

(57) ABSTRACT

A light emitting phosphor material for an alternating current thin-film electroluminescent device that includes the phosphor material sandwiched between a pair of dielectric layers. The phosphor material comprises a first layer having a thickness greater than 600 nanometers wherein the first phosphor material has a luminance output at 25 degrees C. and a decreased luminance output at 50 degrees C. greater than 20 percent of the luminance output at 25 degrees C. The phosphor material comprises a second phosphor layer overlaying the first phosphor layer having a thickness less than 400 nanometers wherein the decreased luminance output at 50 degrees C. is less than 20 percent with the second phosphor layer.

42 Claims, 7 Drawing Sheets

OTHER PUBLICATIONS

Sun, et al, "*A Bright and Efficient New Blue TFEL Phosphor*," (At least one year prior to filing date); (4 pages).
Troppenz, U., "*Electroluminescence Of SrS: Cu and SrS: Cu,Ag At High Ambient Temperatures*," (At least one year prior to filing date); (3 pages).
Sey–Shing Sun; "*Blue Emitting SrS:Cu TFEL Phosphor Development*," IDRC Workshop (1998); (7 pages).
Vlasenko, N.A, et al; "*Temperature Behavior of Characteristics of SrS:Cu(Ag) TFEL Devices Within Temperature Range from 20 to 50 °C*," (At least one year prior to filing date); (13 pages).
Tanaka, S., et al.; "*Excitation Mechanism in White–Light Emitting SrS:Pr, K and SrS:Ce, K, Eu Thin Film Electroluminescent Devices*," Springer Proceedings in Physics, vol. 38; (1989); pp. 56–59.
Ono, Yoshimasa A., "*Electroluminescent Displays*," vol. 1; World Scientific; (1995), pp. 1–170.
Glasse, G; "*Luminescent Materials*," Springer–Verlag (1995); pp. 1–232.
Hiroshi Kobayashi, et al; "*Thin Film ZnS:Mn AC–Electroluminescent Device with a Ge Layer*," IEEE (1982); pp. 1626–1630.
Junichi Ohwaki, et al; "*Stacked Insulator Structure Thin–Film Electroluminescent Display Devices*," The Electrochemical Society, Inc. (vol. 137) (Jan. 1990); pp. 340–342.
L.V. Pham, et al; "*Electrical characterization of blue electroluminescent devices*," Advanced Flat Panel Display Technologies; P.S. Friedman, SPIE 2174, p. 190 (1994) (10 pages).
James D. Britton, et al; "*Modification of Dielectric–Phosphor Interface In A.C. Thin Film electroluminescent Display Devices*," University of Texas at El Paso, (At least one year prior to filing date); (6 pages).
Christopher N. King, et al; "*Full–Color 320 X 240 TFEL Display Panel*," E. Display (1987) pp. 14–17.
Marja Leppanen, et al; "*Broadband double layer phosphor for an inverted filtered RGB electroluminescent display*," Euoro Display (1993) (4 pages).
Takashi Nire, et al; "*Multi–Color TFEL Display Panel with a Double Electro–Interface Structured A ve Layer*," 1992 SID Digest (4 pages).
Shosaku Tanaka, et al; "*Stable White SrS:Ce,K,Eu TFEL with Filters for Full–Color Devices*," Tottori University, Tottori, Japan; (At least one year prior to filing date); (4 pages).
W.A. Barrow, et al; "*A New Class of Blue TFEL Phosphors with Application to a VGA Full–Color Display*," SID 93 Digest; pp. 761–764.
R.H. Mauch, et al; "*32.3: ZnS:Mn/SrS:Ce Multilayer Devices for Full–Color El Applications*," SID 93 Digest; pp. 769–772.
Yoshimasa A. Ono, et al; "*White–light emitting thin film electroluminescent devices with stacked SrS:Ce/CaS:Eu active layers*," J. Appl. Phys. vol. 66 No. 11 Dec. 1, 1989, pp. 5564–5570.
Shosaku Tanaka, et al; "*White Light Emitting Thin–Film Electroluminescent Devices with SrS:Ce, CI/ZnS:Mn Double Phosphor Layers*," Japanese Journal of Applied Physics, vol. 25, No. 3, Mar. 1986; pp. L225–L227.
Shosaku Tanaka, et al; "*Bright white–light electroluminescence based on nonradiative energy transfer in Ce–and Eu–doped SrS thin films*," 1987 American Institute of Physics; pp. 1661–1663.
Takashi Nire, et al; "*Multi–Source Deposition Method for ZnS and SrS Thin–Film Electroluminescent Devices*," Springer Procedures in Physics, vol. 38, "Electroluminescence" p. 180, (1989) (8 pages).
R.H. Mauch, et al; "*Preparation of Eu– And $EuCl_3$–Doped CaS Based Thin Film Electroluminescent Devices*," Applied Physics Services (1990), p. 227; (pp. 227–231).

* cited by examiner

| % of Ce | 25 °C | | 50 °C | | | |
|---|---|---|---|---|---|---|
| | Vth (Volt) | 60 Hz $L_{40}$ (fL) | Vth (Volt) | Voltage shift | 60 Hz $L_{40}$ (fL) | % Luminance reduction |
| None (Control) | 142 | 9.2 | 167 | +25 | 4.5 | -51% |
| 0.010% | 144 | 6.6 | 160 | +16 | 4.7 | -29% |

FIG. 3

| SrS:Ce layer | Vth (Volt) | 60 Hz $L_{40}$ (fL) | $E_{40}$ (lm/W) | $Q_{40}$ (uQ/cm$^2$) | CIE x | CIE y |
|---|---|---|---|---|---|---|
| None | 142 | 9.2 | 0.25 | 1.90 | 0.176 | 0.166 |
| Underlayer only | 149 | 12.8 | 0.25 | 2.73 | 0.184 | 0.253 |
| Overlayer only | 152 | 14.6 | 0.23 | 2.73 | 0.184 | 0.244 |
| Under and Overlayer | 159 | 17.4 | 0.33 | 2.79 | 0.190 | 0.266 |

FIG. 6

| SrS:Ce layer | 25 °C | | 50 °C | | | |
|---|---|---|---|---|---|---|
| | Vth (Volt) | 60 Hz $L_{40}$ (fL) | Vth (Volt) | Voltage shift | 60 Hz $L_{40}$ (fL) | % Luminance reduction |
| None (Control) | 142 | 9.2 | 167 | +25 | 4.5 | -51% |
| Under | 149 | 12.8 | 163 | +14 | 9.4 | -27% |
| Over | 152 | 14.9 | 166 | +14 | 10.6 | -27% |
| Under and Over | 159 | 17.4 | 163 | +4 | 12.8 | -26% |

THIN FILM ELECTROLUMINESCENT DEVICE

The following application relates to a thin film electroluminescent device.

BACKGROUND OF THE INVENTION

Thin films of rare earth doped alkaline earth sulfides such as cerium doped strontium sulfide have been extensively investigated for applications in full color alternating current thin film electroluminescent (ACTFEL) display devices. Such a device is shown in Barrow et al., U.S. Pat. No. 4,751,427, incorporated by reference herein. The emission spectrum of SrS:Ce is very broad covering both blue and green portions of the visible spectrum, i.e., 440 to 660 nm with a peak at around 500 nm. A full color ACTFEL display device can be obtained by adding a red emitting phosphor, for example CaS:Eu or one that has a red component in its emission spectrum. With such a combination of films, one can build a white light emitting phosphor stack. White phosphor structures can then be laminated with primary color filters to build a color display which is very cost effective in terms of production.

With white light emitting phosphor stacks, however, the blue portion of the emission spectrum can be rather weak, particularly strontium sulfide phosphor doped with cerium which in the past has been the most promising of the blue emitting phosphors. Only about 10% of the original luminance can be obtained after filtering if a nearly blue color is to be achieved. For blue coloration in the CIE range of x=0.10, y=0.13 the transmission ratio is further reduced to only about 4%. Therefore, to produce a color display with acceptable luminance, it is necessary to use a lighter blue color filter but this in turn leads to a compromised blue chromaticity. Any display fabricated with such a poor blue chromaticity has a limited color gamut and is unable to produce the range of colors available with CRT or LCD technology.

Therefore, in order to achieve a high performance color ACTFEL display, the blue emission efficiency of the EL phosphor thin film must be greatly improved. In U.S. Pat. No. 4,725,344, Yocom, et al., a method is disclosed for forming alkaline earth sulfide luminescent films by chemical reaction between alkaline earth metal halide and hydrogen sulfide on heated substrates. Yocom, et al. does show a strontium sulfide thin film phosphor which has a more bluish color (CIE x=0.17, y=0.25) than an unfiltered SrS:Ce device. However, the luminance performance of the Yocom et al. device is not high enough for practical application. Experimentation has also been reported regarding SrS:Cu devices which are prepared by sputtering, for example in Ohnishi et al., proceedings of the SID 31/1, 31 (1992). The Ohnishi et al. device, however, is even dimmer than the Yocom et al. device (and no color data is available).

Lehmann, in a paper titled "Alkaline Earth Sulfide Phosphorous Activated by Copper, Sulfur, and Gold," reported that strontium sulfides doped with mono-valent ions with $D^{10}$ configuration, e.g., $Cu^+$,$Ag^+$ plus, emit green and blue light, respectively, when excited by an electron bombardment. Lehmann was attempting to develop a powder phosphor material suitable for cathode ray tube devices and thus are considered unsuitable for alternating current (AC) and thin film electroluminescent devices.

The first blue emitting SrS:Cu electroluminescent device suitable for alternating current, thin-film electroluminescent devices was reported by Kane et al., in a paper entitled "New Electroluminescent Phosphorous Based on Strontium Sulfide." However, the device performance was very poor, e.g., less than 1.0 CD/$M^2$ at 60 Hertz.

Sun et al., in a paper entitled "A Bright And Efficient New Blue TFEL Phosphor," Proceedings of 17th IDRC, Toronto, Canada, p.201 (1997), disclosed a new phosphor, namely, SrS:$Cu^+$, with a luminous performance that was increased over the prior known blue phosphorous in a range of 30. After further development, Sun, in a paper entitled "Blue Emitting SrS:Cu TFEL Phosphor Development", Conference record of the 1998 International Display Research Conference, Asia Display, 1998, Seoul, Korea CD-ROM (1998), disclosed an improved blue emitting phosphor material of SrS:Cu,Ag having twice the luminance efficiency of SrS:Ce due to the enhanced blue emission at wavelengths below 460 nm.

Troppenz., et al., in a paper entitled "Electroluminescence of SrS:Cu and SrS:Cu,Ag at High Ambient Temperatures" shows that SrS:Cu and SrS:Cu,Ag have severe thermal quenching properties. Thermal quenching refers to a reduction in luminance and a concomitant reduction in transferred charge, when an alternating current thin-film electroluminescent device is operated at an elevated temperature. Typically, thermal quenching refers to a reduction in the luminescence of a phosphor when it is operated at an elevated temperature. Normally, thermal quenching is considered within the context of a configuration coordinate diagram and is attributed to a decreasing radiative recombination efficiency of the phosphor as the phonon density increases with increasing temperature. Thus, traditional thermal quenching is due exclusively to an optical effect associated with the temperature dependence of the radiative recombination efficiency.

In contrast, electroluminescence thermal quenching may be employed to denote a reduction in luminescence that is in excess of normal thermal quenching and is associated with a concomitant reduction in transferred charge. Thus, electroluminescent thermal quenching arises from a thermally-activated electrical effect in addition to the optical effect associated with normal thermal quenching.

Referring to FIG. 1, the luminance of a SrS:Cu device is shown at 25° C. and at 50° C. It may be observed that the increase in temperature resulted in nearly at 57% luminance loss at the increased temperature. A similar decrease in luminance likewise occurs with SrS:Cu,Ag phosphor materials. This level of thermal quenching for SrS:Cu and SrS:Cu,Ag is simply too high for a dependable display device.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 3 shows the effect of Ce codoping on the luminance thermal stability of SrS:Cu,Ag devices.

FIG. 6 shows the effect of thin SrS:Ce layers on the luminance performance of SrS:Cu,Ag devices at 25° C.

DETAILED DESCRIPTION OF THE PREFERRED EMBODIMENT

Figure 2:
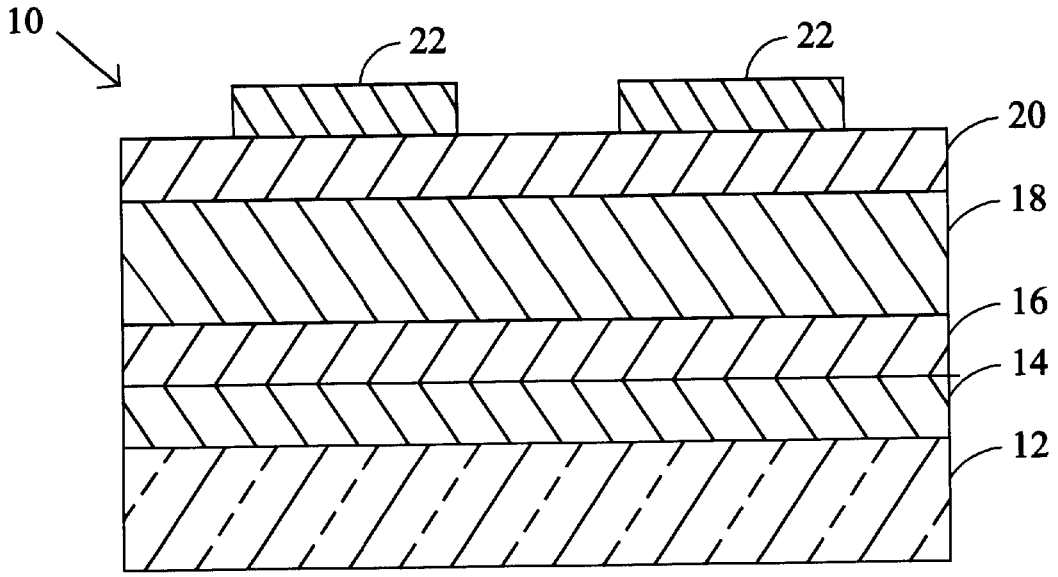
FIG. 2 is a partial side cutaway view of an ACTFEL device.

An alternating current thin-film electroluminescent device 10 as shown in FIG. 2 includes a glass substrate 12 onto which is deposited a layer of indium tin oxide 14. Next an insulator layer 16 comprising an aluminum/titanium oxide is deposited. A phosphor layer 18 comprises a thin film of SrS:Cu,Ag or SrS:Cu. Any other suitable phosphor(s) may likewise be used. The phosphor layer 18 is sandwiched by a second insulator 20 preferably made of barium tantalate (BTO). Aluminum electrodes 22 are placed atop the BTO layer 20. The first insulator layer 16 is preferably approximately 260 nanometers thick and is deposited by atomic layer epitaxy (ALE). The electroluminescent phosphor layer 18 is typically 600 nanometers to 2 micrometers thick and it is deposited by sputtering from an SrS target prepared with the following doping concentration: copper, 0.05 to 5 mol %; and silver 0.05 to 5 mol %. To make a full color panel, a second phosphor layer such as ZnS:Mn or other red emitting phosphor (not shown in FIG. 2) may be deposited on the layer 18. During deposition, the substrate temperature is held to between 75° C. and 500° C. The phosphor films are then annealed at 550° C. to 850° C. in nitrogen. This is followed by the deposition of the second insulator layer 20 which is 300 nanometers of BTO. The top aluminum electrodes 22 complete the device fabrication. Red, blue, and green filters may be interposed between the bottom electrode layer 14 and the viewer (not shown) to provide a filtered full-color TFEL display.

Figure 2A:
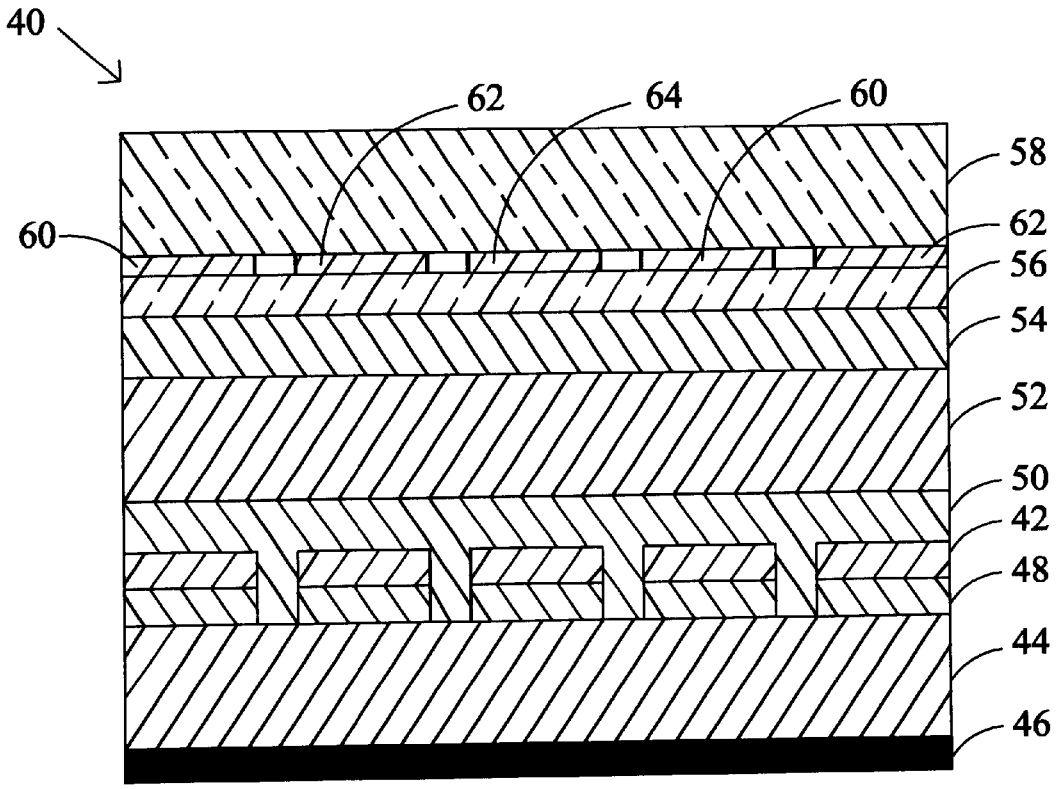
FIG. 2A is a partial side cutaway view of an alternative embodiment of an ACTFEL device.

FIG. 2A shows an "inverted" structure electroluminescent device 40 that is similar to FIG. 2. The device 40 is constructed with a substrate 44 that preferably has a black coating 46 on the lower side if the substrate 44 is transparent. On the substrate 44 are deposited rear electrodes 48. Between the rear electrodes 48 and the rear dielectric layer 50 is a thin film absorption layer 42. The absorption layer is either constructed of multiple graded thin film layers or is a continuous graded thin film layer made by any appropriate method. An electroluminescent layer 52 which may be a laminated structure including at least one layer having the formula $M^{II}$S:Cu,Ag or $M^{II}$S:Cu is sandwiched between a rear dielectric layer 50 and a front dielectric layer 54. It is to be understood that any suitable phosphor(s) may be used. In an alternative embodiment, either dielectric layer 50 or 54 could be removed. A transparent electrode layer 56 is formed on the front dielectric layer 54 and is enclosed by a transparent substrate 58 which includes color filter elements 60, 62 and 64 filtering red, blue and green light, respectively.

After extensive investigation, it appears that electroluminescent thermal quenching in SrS:Cu and SrS:Cu,AG in alternating current thin film electroluminescent devices (ACTFEL) is caused by two independent mechanisms. The mechanisms include (1) a reduction of radiative efficiency and (2) a deterioration of the charge transport properties at elevated temperature. The photoluminescent studies of Troppnez et al., previously discussed, show that the loss in radiative efficiency (first mechanism) is less than 20% between 25 and 80° C. This loss is explained by the increased thermally stimulated non-radiative transition process in SrS:Cu and SrS:Cu,Ag at elevated temperatures. Since thin films and powder materials of SrS:Cu and SrS:Cu, Ag all show the same quenching trend, thermal quenching is considered to be an intrinsic material property for this phosphor system.

Figure 1:
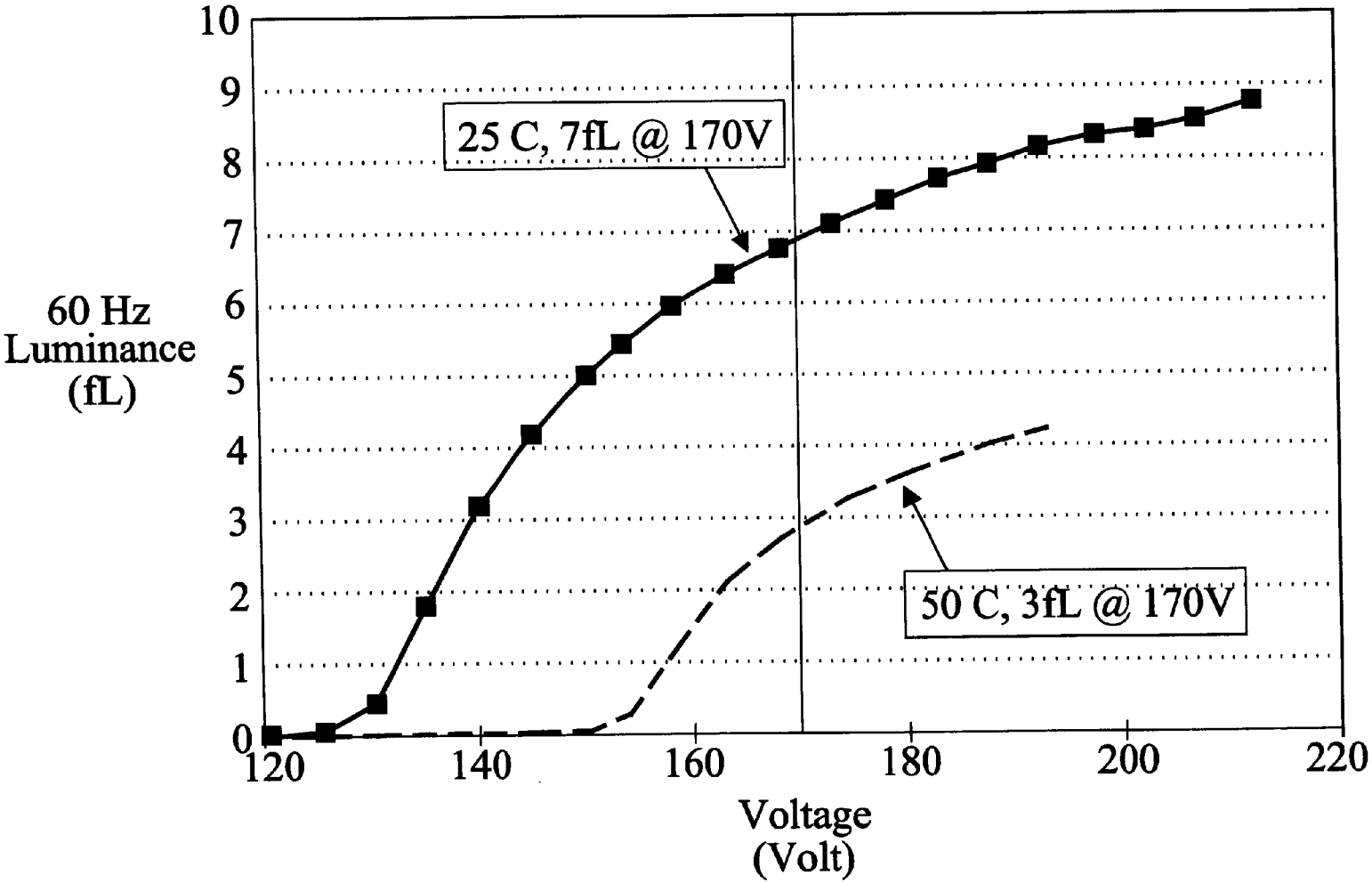
FIG. 1 is a graph of the effects of temperature on luminance-voltage characteristics of a SrS:Cu electroluminescent device.

The deterioration of the charge transport properties (second mechanism) in SrS:Cu with increasing temperature is unusual among ACTFEL devices. Baukol et al., in a paper entitled "Electroluminescent Thermal Quenching in SrS:Cu Thin Films", found the transferred charge threshold increased with temperature in the same fashion as the luminance threshold shift shown in FIG. 1, resulting in a lower transferred charge at fixed voltage at high temperature. Baukol et al. suggested that the degradation is caused by the annihilation of the space charge formed by holes trapped at $Cu^{+}$ions. Vlasenko, et al. in a paper entitled "Temperature Behavior of Characteristics of SrS:Cu(AG) TFEL Devices within Temperature Range From 20 to 50° C.", speculated that this degradation was caused by the energy level of the charge trapping states at the phosphor/insulator interface being too shallow so that the trapped charges are thermalized when the temperature is raised.

The present inventor came to the realization that significant space charge exists in SrS:Ce phosphor materials and that the transport property changes little with temperature. With this realization, the present inventor attempted codoping SrS:Cu,Ag with Ce to enhance the charge transport property of the resulting the phosphor material. As shown in FIG. 3, the threshold voltage shift (25 volt shift to 16 volt shift) and luminance degradation (4.7 fL to 1.9 fL) between 25° C. and 50° C. in SrS:Cu,Ag devices was minimized by Ce codoping. However, to the present inventor's surprise the luminance of the SrS:Cu,Ag phosphor based device was drastically reduced by Ce codoping even at room temperature (9.2 fL to 6.6 fL). As a result, the luminance loss due to Ce codoping exceeded any potential gain in temperature stability and resulted in almost no luminance improvement at 50° C.

Figure 4:
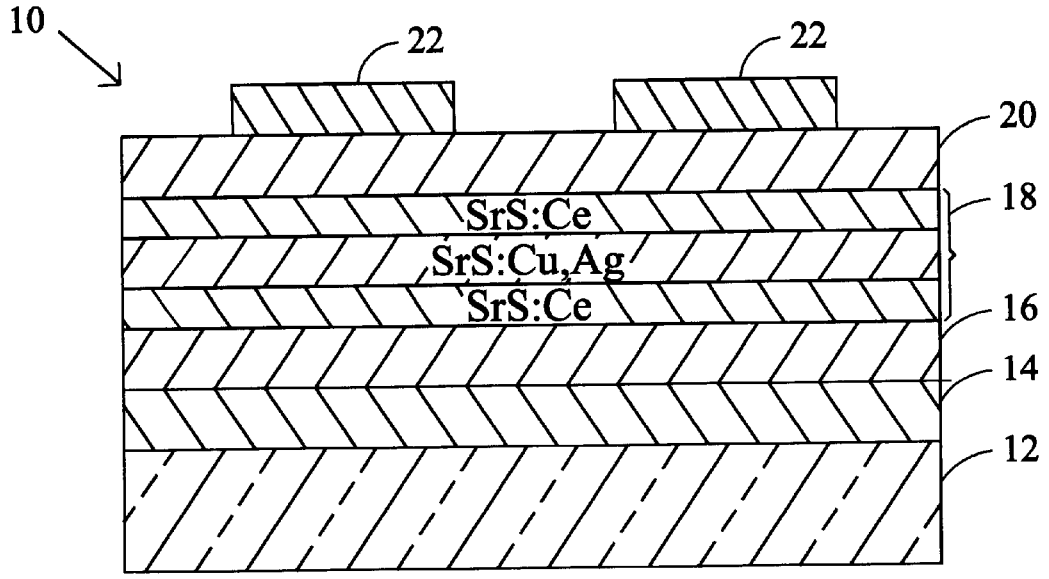
FIG. 4 is a partial side cutaway view of an ACTFEL device.
Figure 4A:
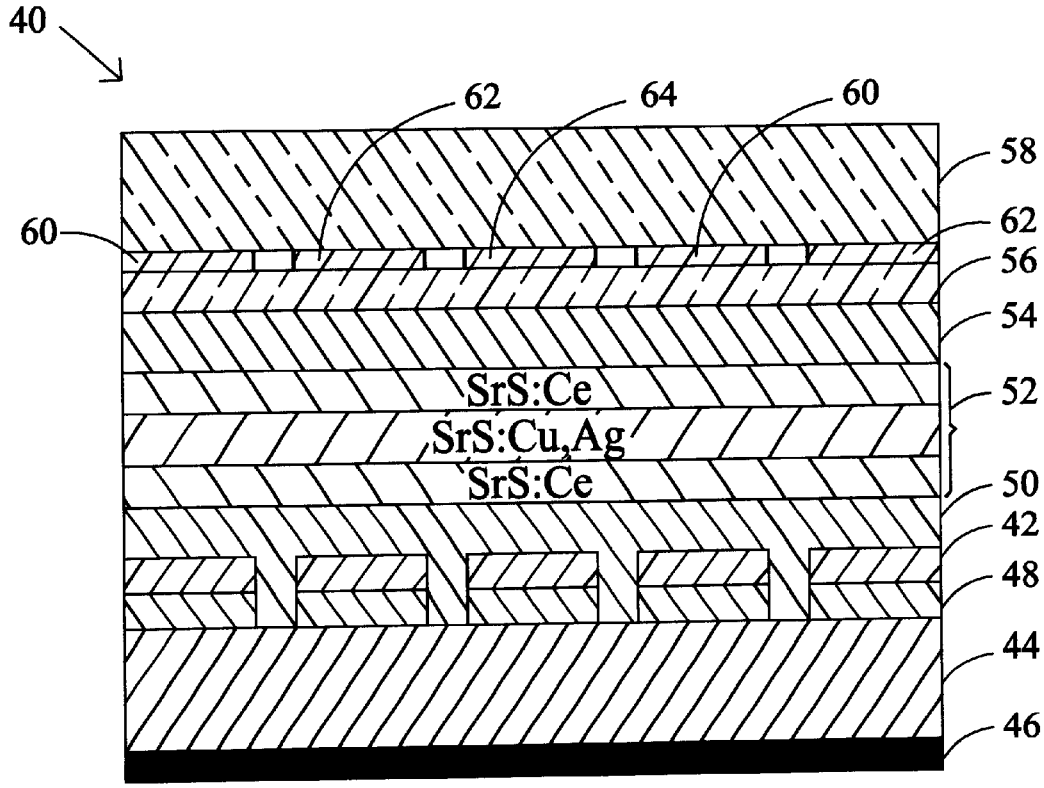
FIG. 4A is a partial side cutaway view of an alternative embodiment of an ACTFEL device.

After further consideration the present inventor came to the realization that in contrast to attempting to modify the bulk characteristics of the SrS:Cu,Ag material, a potentially improved technique involves modifying the interface characteristics of the phosphor material. The present inventor again selected SrS:Ce as the phosphor material and added a layer of SrS:Ce phosphor material to one or both of the interfaces between SrS:Cu,Ag and the insulators as shown in FIGS. 4 and 4A. To the present inventors utter astonishment the additional layer of SrS:Ce drastically reduced the threshold voltage shift and the luminance degradation caused by elevated temperatures. Previously, it was not known that SrS:Ce would, at least partially, overcome the energy level of the charge trapping states at the phosphor/insulator interface being too shallow. Preferably, SrS:Ce has a doping concentration between 0.02 and 0.5 mol %.

Figure 5:
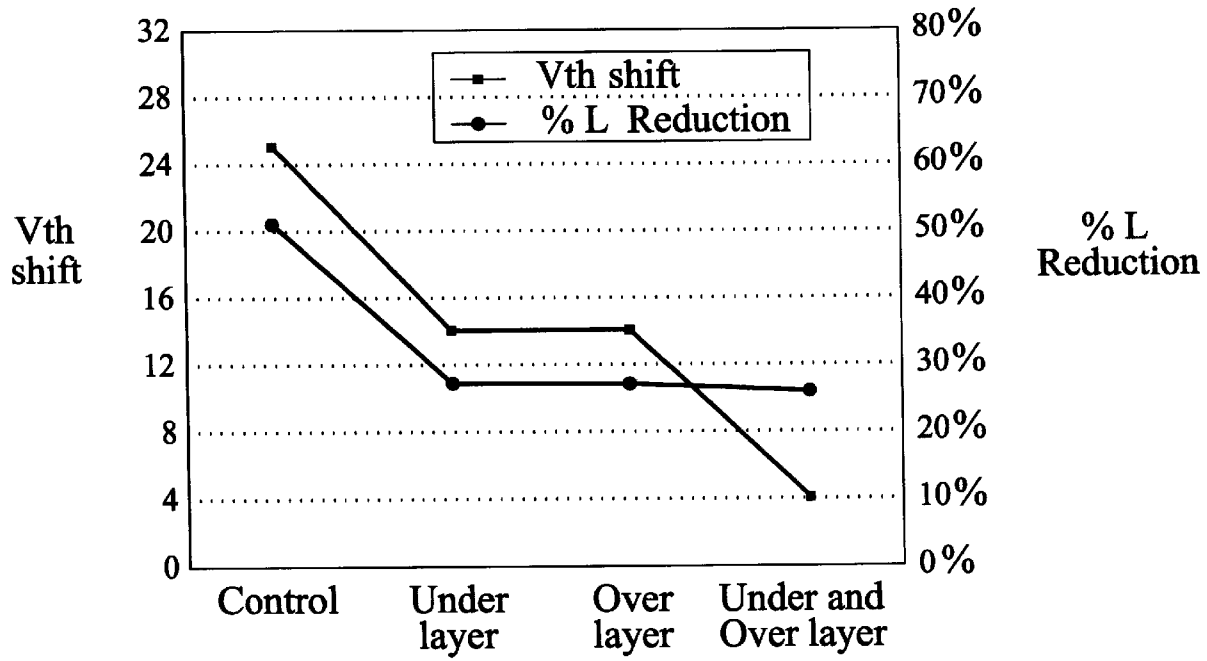
FIG. 5 shows the effect of thin SrS:Ce layers and their location on the luminance thermal stability of SrS:Cu,Ag devices.

As shown in FIG. 5, the addition of a thin layer of SrS:Ce to either the upper or lower SrS:Cu,Ag insulator interface drastically reduces the threshold voltage shift and luminance degradation caused by the rising temperature. A more improved effect is achieved when SrS:Ce thin layers are added to both the upper and lower interfaces resulting in the threshold shift being reduced to around 4 volts and luminance deterioration was minimized to less than 26%. The thickness of each of the SrS:Ce layers is preferably between 50 and 400 nm.

It is also noted that the selection of SrS:Ce in combination with SrS:Cu or SrS:Cu,Ag would not be a normal stack configuration of phosphor materials for a full color display because SrS:Cu, SrS:Cu,Ag, and SrS:Ce are all used as the "blue" phosphor and there is no motivation to include multiple different "blue" phosphors in an electroluminescent stack.

Figure 7:
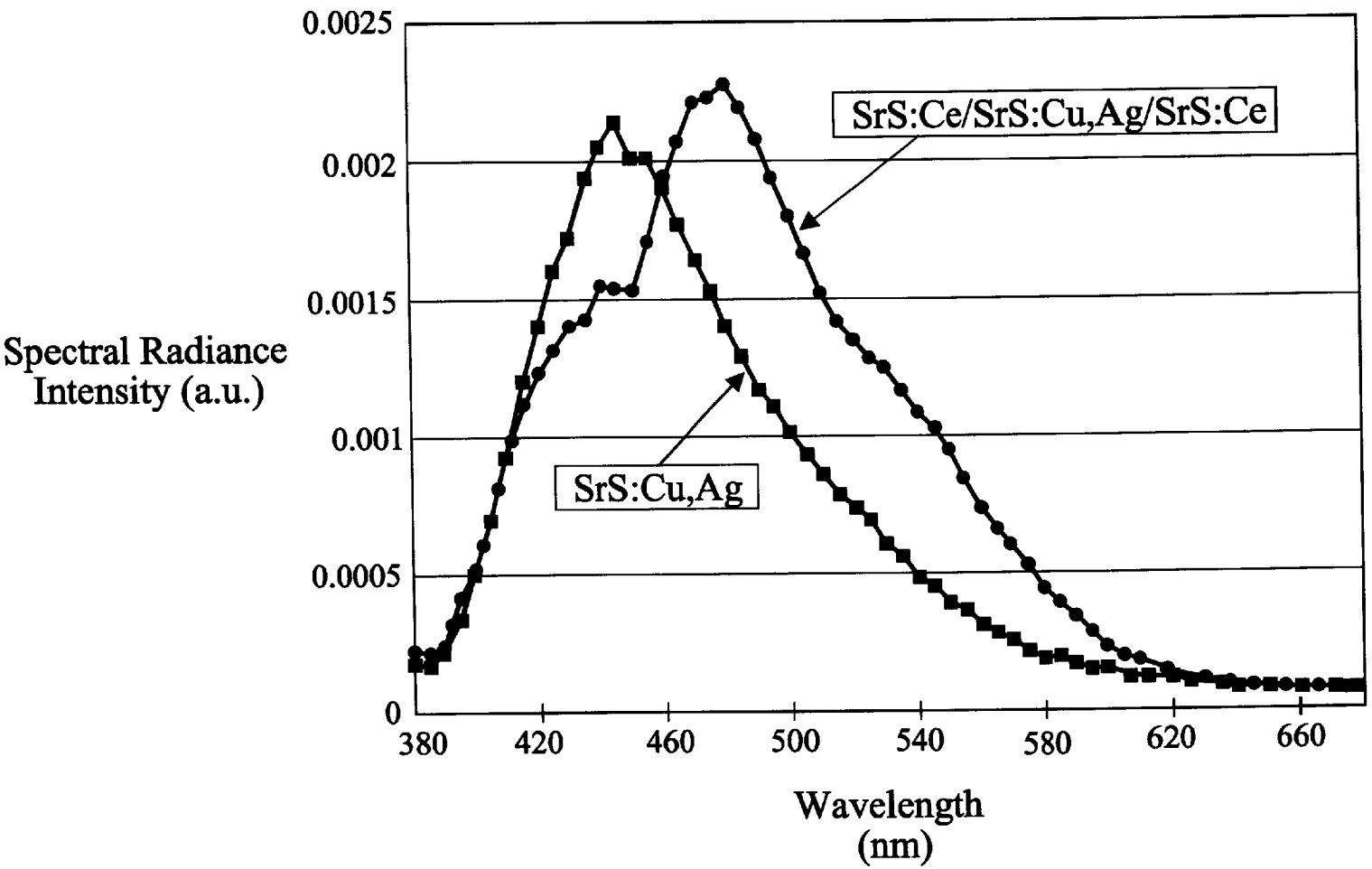
FIG. 7 shows the spectral radiance intensity versus wavelength of SrS:Cu,Ag and SrS:Ce/SrS:Cu,Ag/SrS:Ce.

Referring to FIG. 6, during further measurements the present inventor was further surprised to observe that the thin layers of SrS:Ce not only improved thermal stability, but also improved the luminance performance by almost 100%. After further consideration, the present inventor speculates that the luminance performance improvement is a result of two effects brought by the addition of SrS:Ce thin layers. The first effect is an increased charge injection, $Q_{40}$, as shown in FIG. 5. The luminance of an electroluminescent device is proportional to the number of the charge transferred between the interfaces. Hence, higher transferred charge, i.e, $Q_{40}$ led to increased electroluminescence. The second effect is a red shift of the emission peak from 440 nm to 480 nm as shown in FIG. 7. Human eyes are more sensitive to a greenish color and hence the increase in luminance. The exact cause for the peak shift is not clear but it is possible that Ce emission at 480 nm is enhanced by absorption of 440 nm emission. This is plausible since SrS:Ce phosphor strongly absorbs photons with peak energy at 440 nm.

Figure 8:
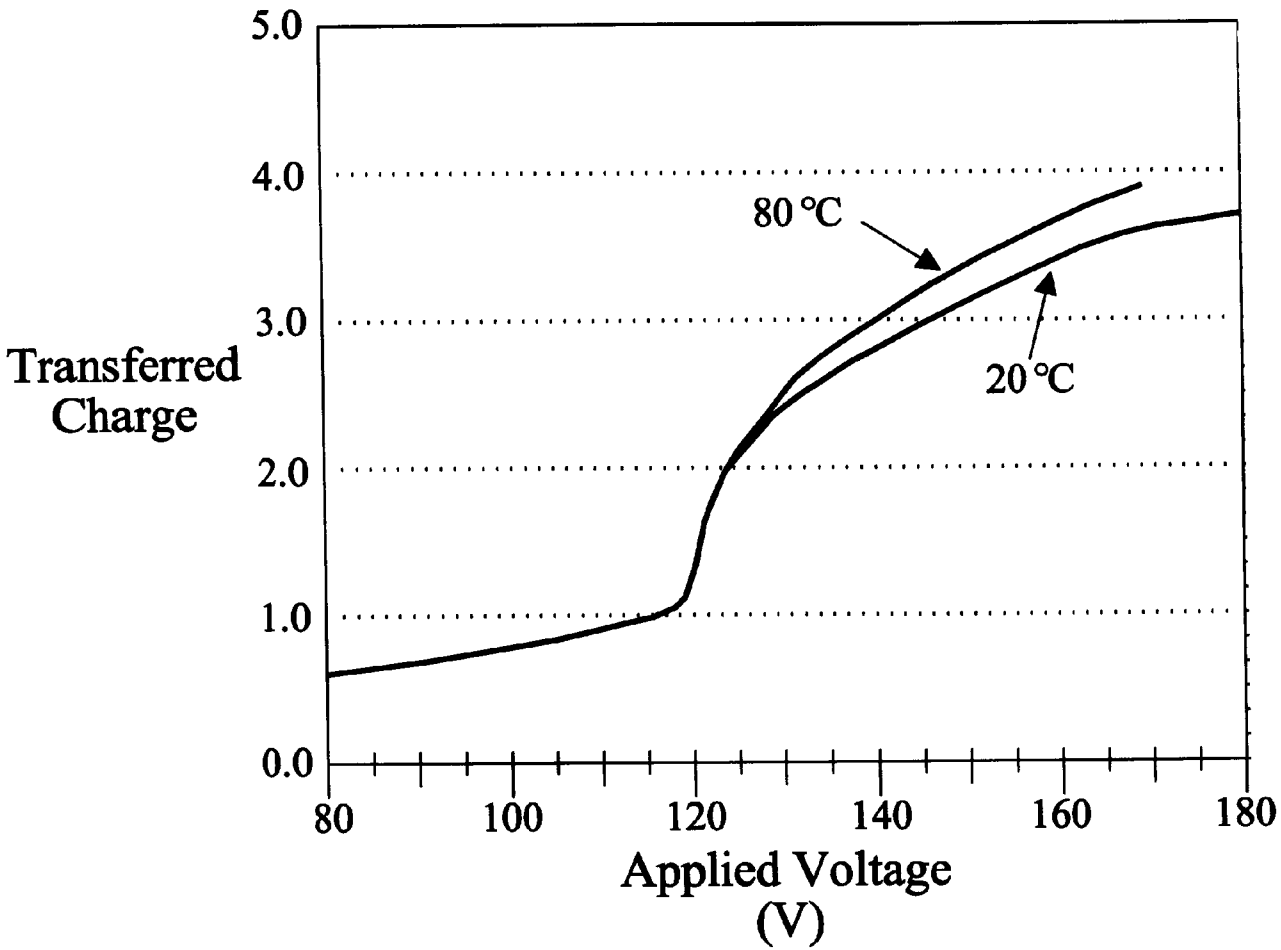
FIG. 8 shows the transferred charge (Q) versus applied voltage (V) of SrS:Ce at 20° C. and 80° C.

Thermally stable electroluminescent phosphors typically only loose no more than 10% of their luminance when raised from 25° C. to 50° C. Marginally thermally stable electroluminescent phosphors are those that loose in excess of 20% of their luminance when raised from 25° C. to 50° C. Electroluminescent phosphors with poor thermal stability loose in excess of 30% of their luminance when raised from 25° C. to 50° C. It is speculated by the present inventor that the resulting decrease in thermal quenching, in a general case applicable to a broad range of electroluminescent phosphor materials, is the result of adding a thin-film of electroluminescent phosphor material to one or both sides of the primary phosphor layer. The reduction in the effects of thermal quenching by ⅓ is considered a significant improvement. In addition, depending on the phosphors selected the effects of thermal quenching may be reduced below the 30% and 20% benchmarks. The primary phosphor layer, for example, may have a thickness in the range of 600 to 2000 nanometers while the thin film may have a thickness in the range of 50 nanometers to 400 nanometers, and more preferably 200–300 nanometers. It would be noted that phosphors with a thickness of 50 to 400 nanometers are generally inefficient and unsuitable as a primary phosphor material. It may be observed that the range of the thickness of the thin film is generally less than that typically used for the primary light emitting electroluminescent phosphor material. In addition, it is further speculated by the present inventor that using the same host (e.g., SrS) for both the primary electroluminescent phosphor material and the thin film of additional electroluminescent phosphor material significantly improves the thermal quenching. The present inventor further speculates that the use of a phosphor material with bulk thermal stability of less than 10% change in the Q-V characteristics between 20° C. and 80° C. at 1 Khz likewise provides the necessary charge injection to the primary light emitting phosphor, as shown in FIG. 8.

It is also understood that a broadband (white) emitting EL phosphor can be achieved by laminating SrS:Cu,Ag/SrS:Ce or SrS:Cu/SrS:Ce layer with a ZnS:Mn or other yellow or red/green emitting phosphor layer to produce white monochrome or color EL displays.

It will also be understood that although the preferred embodiment has been described primarily in terms of a conventional ACTFEL device which will be viewed with the glass substrate forming the face of a TFEL panel, the phosphor of the preferred embodiment may also be used in an inverted structure and viewed from film side of the structure. In the latter case the first deposited electrode will be a refractive metal such as molybdenum. In addition, the phosphor materials may likewise be used with active matrix thin film electroluminescent devices.

It will also be understood that SrS:Ag,Cu and SrS:Cu together with thermal quenching are also a likely phosphor candidate for other display technologies, e.g., FED or backlight for LCD. It is also to be understood that any suitable technique may be used to manufacture the phosphors, such as sputtering, ALE, evaporation, CVD, etc.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A light emitting phosphor material for an alternating current thin-film electroluminescent device that includes said phosphor material sandwiched between a pair of dielectric layers, where said phosphor material comprises:

(a) a first phosphor layer having a thickness greater than 600 nanometers wherein said first phosphor material has a luminance output at 25° C. and a decreased luminance output at 50° C. greater than 20% of said luminance output at 25° C.;

(b) a second phosphor layer overlaying said first phosphor layer having a thickness less than 400 nanometers wherein said decreased luminance output at 50° C. is less than 20% with said second phosphor layer.

2. The phosphor material of claim 1 wherein said decreased luminance output at 50° C. with said second phosphor layer is greater than ⅓.

3. The phosphor material of claim 1 wherein said second phosphor layer has a thickness of less than 200 nanometers.

4. The phosphor material of claim 1 wherein said first phosphor comprises at least one of (a) $M^{II}$S:D,H wherein $M^{II}$ is strontium, S is sulphur, D is copper, and H is silver; and (b) $M^{II}$S:D wherein $M^{II}$ is strontium, S is sulphur, and D is copper.

5. The phosphor material of claim 4 wherein said second phosphor comprises $M^{II}$S:D wherein $M^{II}$ is strontium, S is sulphur, D is Cerium.

6. The phosphor material of claim 1 wherein said first phosphor and said second phosphor have the same host.

7. The phosphor material of claim 6 wherein said host is SrS.

8. The phosphor material of claim 1, further comprising a third phosphor layer overlaying said first phosphor layer having a thickness less than 400 nanometers wherein said decreased luminance output at 50° C. with said third phosphor material is less than said decreased luminance output without said third phosphor material.

9. The phosphor material of claim 8 wherein said first phosphor comprises at least one of (a) $M^{II}S$:D,H wherein $M^{II}$ is strontium, S is sulphur, D is copper, and H is silver; and (b) $M^{II}S$:D wherein $M^{II}$ is strontium, S is sulphur, and D is copper.

10. The phosphor material of claim 9 wherein said second phosphor material comprises $M^{II}S$:D wherein $M^{II}$ is strontium, S is sulphur, D is Cerium.

11. The phosphor material of claim 10 wherein said third phosphor material comprises $M^{II}S$:D wherein $M^{II}$ is strontium, S is sulphur, D is Ce.

12. A light emitting phosphor material for an alternating current thin-film electroluminescent device that includes said phosphor material sandwiched between a pair of dielectric layers, where said phosphor material comprises:

(a) a first phosphor layer having a thickness greater than 600 nanometers wherein said first phosphor material has a luminance output at 25° C. and a decreased luminance output at 50° C. greater than 30% of said luminance output at 25° C.;

(b) a second phosphor layer overlaying said first phosphor layer having a thickness less than 400 nanometers wherein said decreased luminance output at 50° C. is less than 30% with said second phosphor layer.

13. The phosphor material of claim 12 wherein said decreased luminance output at 5° C. with said second phosphor layer is greater than ⅓.

14. The phosphor material of claim 12 wherein said second phosphor layer has a thickness of less than 200 nanometers.

15. The phosphor material of claim 12 wherein said first phosphor comprises at least one of (a) $M^{II}S$:D,H wherein $M^{II}$ is strontium, S is sulphur, D is copper, and H is silver; and (b) $M^{II}S$:D wherein $M^{II}$ is strontium, S is sulphur, and D is copper.

16. The phosphor material of claim 15 wherein said second phosphor comprises $M^{II}S$:D wherein $M^{II}$ is strontium, S is sulphur, D is Cerium.

17. The phosphor material of claim 12 wherein said first phosphor and said second phosphor have the same host.

18. The phosphor material of claim 17 wherein said host is SrS.

19. The phosphor material of claim 12, further comprising a third phosphor layer overlaying said first phosphor layer having a thickness less than 400 nanometers wherein said decreased luminance output at 50° C. with said third phosphor material is less than said decreased luminance output without said third phosphor material.

20. The phosphor material of claim 19 wherein said first phosphor comprises at least one of (a) $M^{II}S$:D,H wherein $M^{II}$ is strontium, S is sulphur, D is copper, and H is silver; and (b) $M^{II}S$:D wherein $M^{II}$ is strontium, S is sulphur, and D is copper.

21. The phosphor material of claim 20 wherein said second phosphor material comprises $M^{II}S$:D wherein $M^{II}$ is strontium, S is sulphur, D is Cerium.

22. The phosphor material of claim 21 wherein said third phosphor material comprises $M^{II}S$:D wherein $M^{II}$ is strontium, S is sulphur, D is Ce.

23. A light emitting phosphor material for an alternating current thin-film electroluminescent device that includes said phosphor material sandwiched between a pair of dielectric layers, where said phosphor material comprises:

(a) a first phosphor layer having a luminance output at 25 degrees C. and a decreased luminance output at 50 degrees C greater than 20 percent of said luminance output at 25 degrees C., the difference between said luminance at 25 degrees C. and 50 degrees C. being a luminance reduction;

(b) a second phosphor layer overlaying said first phosphor layer wherein said luminance reduction is reduced by at least ⅓ with the addition of said second phosphor layer;

(c) said first phosphor layer and said second phosphor layer having the same host lattice; and (d) said first phosphor layer has a thickness greater than 600 nanometers and said second phosphor layer has a thickness less than 400 nanometers.

24. The phosphor material of claim 23 wherein said second phosphor layer has a thickness of less than 200 nanometers.

25. The phosphor material of claim 23 wherein said first phosphor comprises at least one of:

(a) $M^{II}S$:D,H wherein $M^{II}$ is strontium, S is sulphur, D is copper, and H is silver; and (b) $M^{II}S$:D wherein $M^{II}$ is strontium, S is sulphur, and D is copper.

26. The phosphor material of claim 25 wherein said second phosphor comprises $M^{II}S$:D wherein $M^{II}$ is strontium, S is sulphur, D is Cerium.

27. The phosphor material of claim 23 wherein said host is SrS.

28. Phosphor material of claim 23, further comprising a third phosphor layer overlaying said first phosphor layer wherein said decreased luminance output at 50° C. with said third phosphor material is less than said decreased luminance output without said third phosphor material.

29. The phosphor material of claim 28 wherein said first phosphor comprises at least one of (a) $M^{II}S$:D,H wherein $M^{II}$ is strontium, S is sulphur, D is copper, and H is silver; and (b) $M^{II}S$:D wherein $M^{II}$ is strontium, S is sulphur, and D is copper.

30. The phosphor material of claim 29 wherein said second phosphor material comprises $M^{II}S$:D wherein $M^{II}$ is strontium, S is sulphur, D is Cerium.

31. The phosphor material of claim 30 wherein said third phosphor material comprises $M^{II}S$:D wherein $M^{II}$ is strontium, S is sulphur, D is Cerium.

32. A light emitting phosphor material for an alternating current thin-film electroluminescent device that includes said phosphor material sandwiched between a pair of dielectric layers, where said phosphor material comprises:

(a) a first phosphor layer having a thickness greater than 600 nanometers wherein said first phosphor material has a luminance output at 25° C. and a decreased luminance output at 50° C. greater than 10% of said luminance output at 25° C.;

(b) a second phosphor layer overlaying said first phosphor layer having a thickness less than 400 nanometers wherein said second phosphor layer is characterized by less than 10% change in its Q-V characteristics between 20° C. and 80° C. at 1 KHz.

33. The phosphor material of claim 32 wherein said decreased luminance output at 50° C. with said second phosphor layer is greater than ⅓.

34. The phosphor material of claim 32 wherein said second phosphor layer has a thickness of less than 200 nanometers.

35. The phosphor material of claim 32 wherein said first phosphor comprises at least one of (a) $M^{II}S$:D,H wherein $M^{II}$ is strontium, S is sulphur, D is copper, and H is silver; and (b) $M^{II}S:D$ wherein $M^{II}$ is strontium, S is sulphur, and D is copper.

36. The phosphor material of claim 35 wherein said second phosphor comprises $M^{II}S:D$ wherein $M^{II}$ is strontium, S is sulphur, D is Cerium.

37. The phosphor material of claim 32 wherein said first phosphor and said second phosphor have the same host.

38. The phosphor material of claim 37 wherein said host is SrS.

39. The phosphor material of claim 32, further comprising a third phosphor layer overlaying said first phosphor layer having a thickness less than 400 nanometers wherein said decreased luminance output at 50° C. with said third phosphor material is less than said decreased luminance output without said third phosphor material.

40. The phosphor material of claim 39 wherein said first phosphor comprises at least one of (a) $M^{II}S:D,H$ wherein $M^{II}$ is strontium, S is sulphur, D is copper, and H is silver; and (b) $M^{II}S:D$ wherein $M^{II}$ is strontium, S is sulphur, and D is copper.

41. The phosphor material of claim 40 wherein said second phosphor material comprises $M^{II}S:D$ wherein $M^{II}$ is strontium, S is sulphur, D is Cerium.

42. The phosphor material of claim 41 wherein said third phosphor material comprises $M^{II}S:D$ wherein $M^{II}$ is strontium, S is sulphur, D is Ce.

* * * * *

UNITED STATES PATENT AND TRADEMARK OFFICE

CERTIFICATE OF CORRECTION

PATENT NO. : 6,451,460 B1 
DATED : September 17, 2002
INVENTOR(S) : Sey-Shing Sun and Michael S. Bowen It is certified that error appears in the above-identified patent and that said Letters Patent is hereby corrected as shown below:

Title page,
Item [73], Assignee, change "Plannar" to -- Planar --.

Column 2,
Line 41, change "the luminance of a SrS:Cu" to -- the luminance of an SrS:Cu --.
Line 42, change "25°C." to -- 25°C --.

Column 3,
Line 13, change "20°C." to -- 20°C --.
Line 36, change "75°C." to -- 75°C --.
Line 37, change "550°C." to -- 550°C --.
Line 37, change "850°C." to -- 850°C --.
Line 65, change "SrS:Cu, AG" to -- SrS,Cu, Ag --.

Column 4,
Line 4, change "Troppnez" to -- Troppenz --.
Line 5, change "25°" to -- 25°C --.
Line 24, change "SrS:Cu(AG)" to -- SrS:Cu, Ag --.
Line 38, change "between 25°C. and 50°C" to -- between 25°C and 50°C --.
Line 35, change "resulting the phosphor material" to -- resulting phosphor material --.
Line 54, change "to the present inventors" to -- the present inventor's --.

Column 5,
Line 33, change "only loose no more than 10%" to -- only lose no more than 10% --.
Line 34, change "25°C. to 50°C." to -- 25°C to 50°C --.
Line 35, change "those that loose in excess of 20%" to -- those that lose in excess of 20% --.
Lines 36 and 39, change "25°C." to -- 25°C --.
Line 38, change "loose in excess of 30%" to -- lose in excess of 30% --.
Line 65, change "20°C. and 80°C." to -- 20°C and 80°C --.

Column 6,
Lines 36 and 38, change "25°C." to -- 25°C --.
Lines 37, 42, 45 and 65, change "50°C." to -- 50°C --.

UNITED STATES PATENT AND TRADEMARK OFFICE

CERTIFICATE OF CORRECTION

PATENT NO. : 6,451,460 B1 
DATED : September 17, 2002
INVENTOR(S) : Sey-Shing Sun and Michael S. Bowen It is certified that error appears in the above-identified patent and that said Letters Patent is hereby corrected as shown below:

Column 7,
Line 28, "output at 5°C" to -- output at 50°C --.

Signed and Sealed this

Twenty-fourth Day of January, 2006

JON W. DUDAS
*Director of the United States Patent and Trademark Office*